United States Patent [19]

Engelman

[11] Patent Number: 4,864,477

[45] Date of Patent: Sep. 5, 1989

[54] TROUBLE LIGHT

[76] Inventor: Donald J. Engelman, R.R. #4, Box 243B, Kankakee, Ill. 60901

[21] Appl. No.: 159,415

[22] Filed: Feb. 16, 1988

Related U.S. Application Data

[63] Continuation-in-part of Ser. No. 69,367, Jul. 2, 1987, abandoned.

[51] Int. Cl.[4] ..... F21V 15/02

[52] U.S. Cl. ..... 362/376; 362/373

[58] Field of Search ..... 362/376, 373, 294

[56] References Cited

U.S. PATENT DOCUMENTS

| | | | |
|---|---|---|---|
| 974,226 | 11/1910 | Benjamin | 362/376 |
| 2,294,580 | 9/1942 | Skinner et al. | 362/294 X |
| 2,295,339 | 9/1942 | Ericson | 362/294 X |
| 2,460,173 | 1/1949 | Halbing | 362/376 |
| 2,554,565 | 5/1951 | Fike | 362/376 X |
| 2,576,687 | 9/1951 | Benander | 362/376 |
| 2,789,208 | 4/1957 | Thatcher | 362/373 X |
| 3,108,752 | 2/1962 | Duprey | 362/343 X |
| 3,119,568 | 1/1968 | Broder | 362/344 |
| 3,175,079 | 3/1965 | Gieser | 362/267 |
| 3,474,244 | 10/1969 | Hanlon | 362/296 |
| 3,814,927 | 6/1974 | Buzza | 362/376 X |
| 3,935,560 | 1/1976 | Dorn | 362/378 |
| 3,996,459 | 12/1976 | Schwartz | 362/344 |
| 4,086,482 | 4/1978 | Torgerson | 362/376 |
| 4,141,062 | 2/1979 | Trueblood | 362/400 |
| 4,236,195 | 11/1980 | Kovacik | 362/376 |
| 4,258,414 | 3/1981 | Sokol | 362/421 |
| 4,275,435 | 6/1981 | Dorn | 362/376 X |
| 4,310,874 | 1/1982 | Spiteri | 362/376 X |
| 4,321,660 | 3/1982 | Sokol | 362/368 |
| 4,328,535 | 5/1982 | Cornell | 362/294 X |
| 4,419,720 | 12/1983 | Kenney | 362/376 X |
| 4,564,894 | 1/1986 | Gonzalez | 362/376 X |
| 4,594,647 | 6/1986 | Dippert | 362/376 |
| 4,639,842 | 1/1987 | Upchurch | 362/376 |

FOREIGN PATENT DOCUMENTS

| | | | |
|---|---|---|---|
| 259245 | 6/1949 | Switzerland | 362/307 |

OTHER PUBLICATIONS

J. C. Whitney & Co., *Parts & Accessories Catalog,* Chicago, Ill., 1984, pp. 87, 131.

McMaster-Carr Supply Co., *Catalog 91,* Chicago, Ill., 1985, pp. 80–81.

*Primary Examiner*—Craig R. Feinberg

*Attorney, Agent, or Firm*—Lockwood, Alex, Fitzgibbon & Cummings

[57] ABSTRACT

A trouble light shield is disclosed for use with an elongated handle member receiving an electric light bulb thereon. The shield includes a reflector partially surrounding the light bulb and a guard assembly having a plurality of radially spaced vertical wires. Collars located at the base of the reflector and guard assembly space the reflector a predetermined distance away from the light bulb and guard assembly, while posts which extend from the guard assembly engage the reflector to maintain its predetermined distance and also to prevent any substantial contact between the reflector and guard assembly.

15 Claims, 2 Drawing Sheets

TROUBLE LIGHT

REFERENCE TO RELATED APPLICATIONS

This application is a continuation-in-part of application Ser. No. 69,367, filed July 2, 1987, now abandoned.

BACKGROUND AND SUMMARY OF INVENTION

The present invention relates to trouble lights and, more particularly, to an improved trouble light and shield therefor in which the risk of being burned through contact therewith is minimized.

Trouble lights are a common device used by service personnel and many automobile owners to illuminate an area, such as, for example, under an automobile, where inadequate lighting conditions hinder the ability to work in such an area. In the past, trouble lights typically consisted of a switch and socket assembly, a light bulb secured within the socket, and a housing combining a sheet metal reflector and a wire guard. These lights utilize the reflector positioned on one side of the bulb to reflect the light towards the work area. The wire guard portion of the housing was used to prevent inadvertent contact with the bulb which would cause burns and possibly break the bulb. Also, the reflector in these lights typically abutted the wire guard and provided one or more points of contact between the two and transferred heat to the wire guard. A problem associated with this type of light stems from the fact that the light bulbs utilized therein must provide sufficient illumination on the work area. The bulbs which fulfill this need develop a considerable amount of heat. Since the bulb is positioned in close proximity to the reflector portion of the housing, the temperature of the reflector portion can rise due to radiation and contact between the reflector and wire guards and produce a painful burn, even after only a short period of use. In addition, trouble lights are often used in applications where the work space is cramped. Therefore, it is desirable to construct the housing assembly as small as possible so that the light can be inserted where desired. Decreasing the size of the housing, however, moves the reflector portion closer to the light bulb and also moves the reflector into contact with the guard and thus increases the temperature of the reflector.

Various types of trouble lights have been designed in an effort to prevent burns caused by the reflector. One is disclosed in U.S. Pat. No. 3,108,752 in which a trouble light having a housing made from a wire guard and a sheet metal shield is disclosed. A reflector having ventilating slots therein is concentrically mounted to the shield between the shield and the bulb by a pair of rivets. While such a construction initially insulates the shield, after prolonged use, both the reflector and the shield attain high temperatures due to the minimal circulation of air between the reflector and the shield.

U.S. Pat. No. 4,328,535 describes a trouble light having a thermal insulating cloth pad which is positioned on the exterior surface of the reflector. This insulating pad may become snagged in a congested work area and become separated from the reflector and thus require the user to occasionally reposition it. In addition, because the pad is made from cloth, it will likely absorb moisture and/or grease and/or oil whereby it will readily conduct heat through the pad, or even worse, become a fire hazard.

Fluorescent bulbs have also been proposed to replace the typical incandescent bulb because of their lower operating temperatures. However, fluorescent bulbs are substantially more expensive than a comparable incandescent bulb thus making the fluorescent-type trouble lights cost prohibitive for many purchasers.

The trouble light of the present invention overcomes the aforementioned shortcomings by utilizing a wire guard assembly which completely encircles the bulb and reflector. The reflector is positioned substantially adjacent the bulb. An air gap is provided between the reflector and the wire guard and contact between the reflector and guard assembly is prevented to effectively prevent substantial heat transfer between the reflector and the wire guard. Any minimal heat transfer which may occur is further minimized by coating the wire guard with a thermal and electrical insulator. The wire guard has a plurality of wires which are radically spaced apart and prevent inadvertent contact by the user with the reflector. The air gap between the wires and reflector permits air to freely pass over the reflector and prevent heat transfer to the guard such that the guard maintains a relatively cool temperature which a user may contact without being burned.

Accordingly, it is a general object of the present invention to provide an improved trouble light.

Another object of the present invention is to provide a trouble light having a predetermined distance and an air gap between the reflector and the guard assembly to eliminate heat transfer to the guard assembly.

Another object of the present invention is to provide a trouble light in which the wire guard assembly surrounding the light bulb is coated with a thermal insulator.

A further object of the present invention is to provide a trouble light in which the wire guard surrounding the light bulb is coated with a thermal and electrical insulator.

A still further object of the present invention is to provide a trouble light in which the light bulb enclosed within the housing is readily accessible.

Yet another object of the present invention into provide a trouble light shield with positioning means to maintain the light reflector a predetermined distance from the guard assembly and to prevent relative movement and contact between the two.

These and other objects, features and advantages of the present invention will be clearly understood through a consideration of the following detailed description.

BRIEF DESCRIPTION OF THE DRAWINGS

In the course of this description, reference will be made to the attached drawings in which.

DETAILED DESCRIPTION OF THE INVENTION

Figure 1:
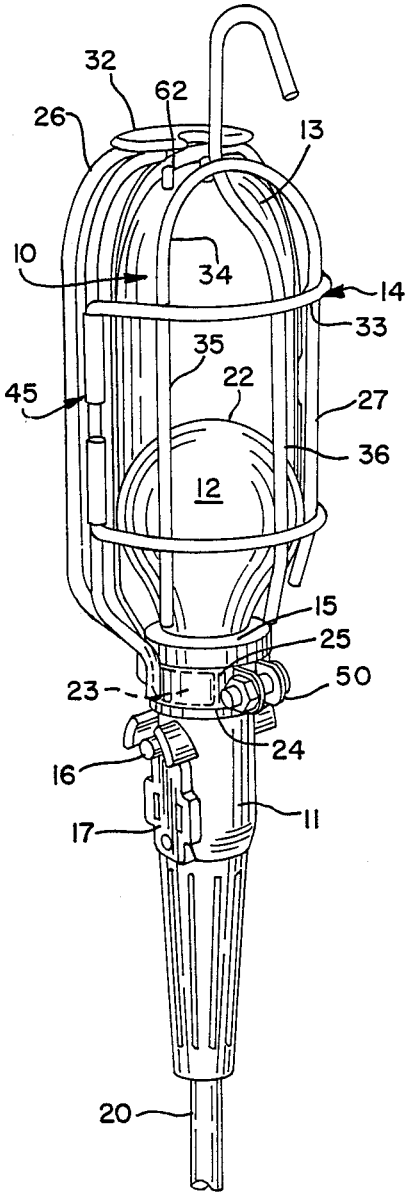
FIG. 1 is a perspective view showing a first embodiment of a trouble light shield constructed in accordance with the principles of the present invention mounted on a trouble light base.

FIG. 1 shows a first embodiment of a trouble light shield 10 incorporating the principles of the present invention. The trouble light shield 10 is shown attached to a conventional handle member 11 which has a light bulb 12 mounted therein. Reflector means in the form of a reflector shield 13 are positioned adjacent the bulb and guard assembly means, indicated generally 14, surround the bulb 12 and reflector means 13.

The handle member 11 is of known construction and includes a conventional socket 15 which receives a light bulb 12. A push-button switch 16 may be provided to operate the light. An outlet 17 may also be provided on handle 11 to provide a convenient location for powering electric hand tools when using the trouble light. An insulated conductor 20 is fed into the handle member 11 through a bore (not shown) in the bottom thereof.

Figure 2:
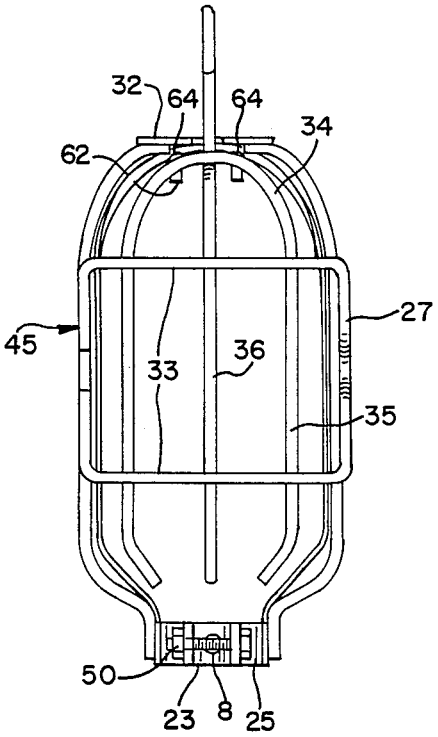
FIG. 2 is a front elevation view of the trouble light shield shown in FIG. 1
Figure 2A:
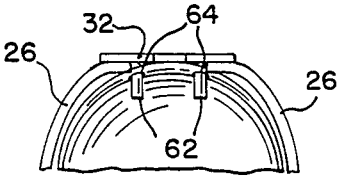
FIG. 2A is an enlarged view of a portion of FIG. 2 with the front access portion of the guard assembly removed.
Figure 3:
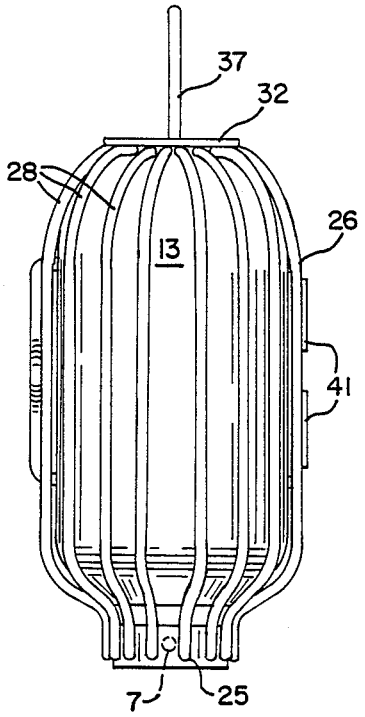
FIG. 3 is a rear elevation view of the trouble light shield shown in FIG. 1.
Figure 5:
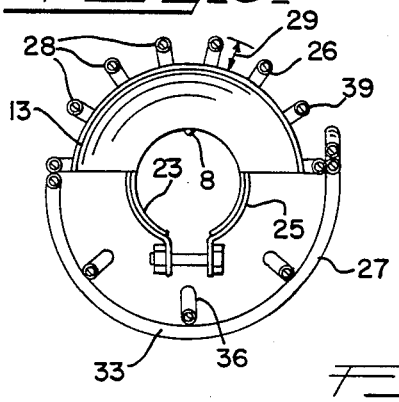
FIG. 5 is a sectional view taken along line 5—5 of FIG. 4 with the light bulb removed for clarity.

Reflector shield 13 is elongate and preferably formed of metal or a suitable temperature resistant material and as seen in FIG. 2A is generally semi-circular in cross-section. It extends beyond the full length of bulb 12 so that it reflects light from the bulb 12 toward the work area. As best shown in FIG. 5, reflector 13 is dimensioned and mounted adjacent socket 15 by way of a first positioning means which includes a first collar 23 such that it is positioned a predetermined distance away from the outer diameter 22 of the bulb 12. First collar 23 fits into a circumferential groove or channel 24 on the handle 11 and is held in place within the channel 24 also by way of the guard assembly portion of the first positioning means which also includes a second collar 25. In order to properly align the reflector 13 within the guard assembly 14, first and second collars may be provided with alignment means in the format of detents 7,8 which engage each other. As best seen in FIGS. 3 & 5 a first detent 7 is disposed on the reflector first collar 23 and a second detent 8 of a shape similar to that of the first detent disposed on the guard assembly second collar 25.

The guard assembly means 14 comprises a fixed guard portion 26 and a pivoting bulb guard access portion 27. Guard portion 26 is formed from a plurality of radially and equally spaced vertical wires 28 which are secured to collar 25 by welding or the like. At their tops 31, the wires are secured to heat transfer means comprising a generally semi-circular flat plate member 32 in a similar manner to provide a rigid guard structure enclosing bulb 12. The wires 28 are preferably constructed of metal, and may be coated with a thermal and/or electrical insulation 39. Through the use of a thermal insulating coating, any temperature increases in the wire guard assembly 14 are further minimized.

The guard access portion 27 of guard assembly means 14 is constructed from the same material as the fixed guard portion 26. As best shown in FIGS. 1–4, the guard access portion 27 is constructed from a wire bent into a generally rectangular-shaped member 33 which forms the horizontal portions of the bulb guard access portion 27. The vertical portions of the guard access portion are preferably formed from a wire bent into a generally U-shaped member 34 in which the legs 35 thereof are substantially vertical. This U-shaped member can also be secured to the rectangular-shaped member 33 by welding or other similar method. An additional vertical member 36 is secured to both the rectangular-shaped member 33 and the U-shaped member 34 and has hanging means thereon which includes hook 37 formed at the top end thereof for hanging the trouble light 10.

One side of the rectangular-shaped member 33 has a pair of opposed vertically depending members 40 which fit into a pair of mating tubes 41 mounted on the end vertical wire of the guard fixed portion 26 in order to create a hinge assembly 45. The opposite side of rectangular-shaped portion 33 of bulb guard 27 has a tab 46 extending therefrom which engages the other side of reflector guard 26 to form a latch assembly indicated generally at 47.

The reflector shield 13 and guard assembly means 14 are secured in position around bulb 12 and the top of handle member 11 by the first positioning means first and second collars 23,25 which are held in channel 24. The first collar 23 sits within the second collar 25 and is held therein when tightening means, such as nut and bolt assembly 50, is applied. The first and second collars 23,25 establish an initial predetermined distance between the reflector 13 and the fixed guard portion 26 as well as establish a spacing between the light bulb 12 and the reflector 13.

Figure 4:
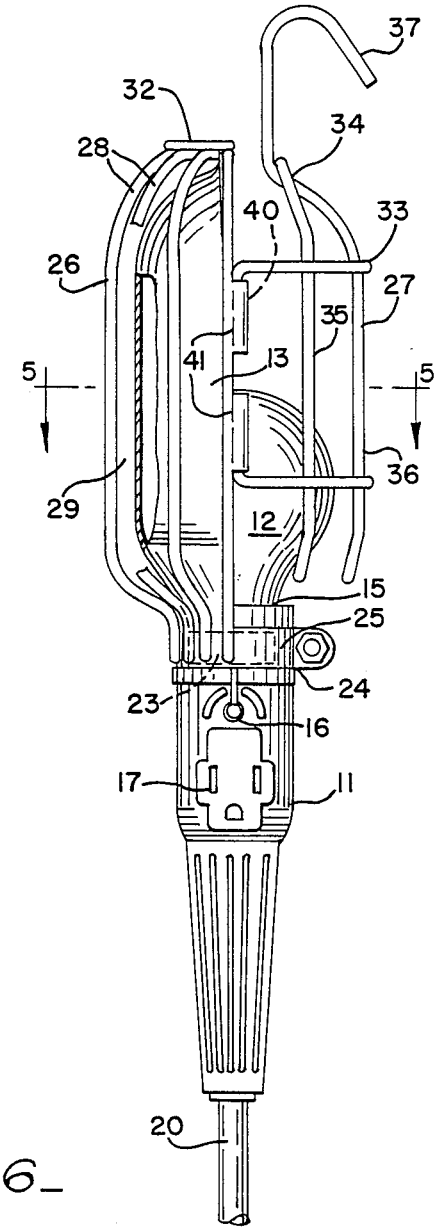
FIG. 4 is a side elevation view, partly in section, of the trouble light shown in FIG. 1.

In an important aspect of the present invention, this first positioning means establishes a predetermined distance which includes an air gap 29 between the reflector 13 and the guard assembly means 14 (FIGS. 4 or 5) therebetween (FIGS. 4–5). This air gap 29 extends about the rear perimeter of the reflector shield 13 and is disposed between the reflector 13 and the radial wires 28 of the guard fixed portion 26. With its air gap 29, this predetermined distance allows air to flow over the rear of reflector shield 13 and so prevents heat transfer between the reflector shield 13 and guard assembly means 14.

In yet another important aspect of the present invention, second positioning means 60 in the form of two posts 62 is provided at the top of the fixed guard portion 26 and maintains the predetermined distance and air gap 29 between the reflector shield 13 and the fixed guard portion 26. Importantly, these posts 62 provide a point of engagement between the reflector shield 13 and fixed guard portion 26 to prevent any relative movement of the reflector shield 13 with respect to the radial wires 28 in case the first and second collars 23,25 loosen. As such, second positioning means prevent the reflector shield 13 from substantially contacting the fixed guard portion 26, thereby eliminating any heat transfer via conduction between them.

As shown in FIG. 2A, two positioning posts 62 depend downwardly from heat transfer means in the form of a semicircular plate 32 and engage the reflector shield 13 by protruding through openings 64 therein. These posts 62 fix the reflector shield 13 in place with respect to the fixed guard portion 26 so that the reflector shield 13 is maintained in its predetermined distance away from the radial wires 28 of the fixed guard portion 26. Contact between the reflector means 13 and the radial wires 28 is thereby prevented and heat cannot be transferred to it through contact alone. The only heat which can be transferred to the guard assembly means 14 is minimal and occurs via of posts 62 to the heat transfer plate 32. The relatively large surface area of plate 32 seems to rapidly disapate heat to the atmosphere.

Figure 6:
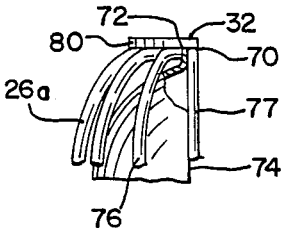
FIG. 6 is an enlarged sectional view illustrating a second embodiment of a trouble light shield constructed in accordance with the principles of the present invention.

FIG. 6 shows another embodiment of a trouble light shield incorporating the principles of the present invention. In this embodiment, the second positioning means 70 includes an outward rim 72 disposed about the periphery of the reflector shield 74. This rim 72 extends outwardly and is held between two adjacent radial wires 76,77 of the fixed guard portion 78. The contact between the reflector shield 74 and the fixed guard portion 78 is limited in this embodiment to the contact points between wires 76,77 and the rim 72. Any heat build up in the reflector 74 is transferred to the heat transfer plate 80 and quickly disapated into the atmosphere.

Preferably, the radial wires 28 are positioned close enough together to prevent the insertion of a user's finger between the wires and into contact with the reflector shield. A distance of approximately ½ inch has been generally found to be satisfactory. The small air gap 29 between the reflector shield 13 and fixed guard assembly 26 allows the two components to be positioned relatively close together in order to provide a trouble light which helps prevent burns yet is no larger than current models. In the event that electrical insulation 39 is used to cover or coat the wires and second collar 24 of guard assembly means 14, the guard assembly means 26 will be electrically insulated from the reflector 13 which reduces the chances of receiving an electrical shock from the reflector 13 through the wire guard 14 in the event of a short circuit.

In addition to utilizing wire or coated wire for constructing the guard assembly means 14, it may be constructed of a plastic material having sufficient strength and moldability characteristics.

It will be understood that the embodiments of the present invention which have been described herein are merely illustrative of an application of the principles of the invention. Numerous modifications may be made by those skilled in the art without departing from the spirit and scope of the invention.

What I claim is:

1. A trouble light shield for use on a trouble light having a combined bulb and handle assembly of the type having an elongated cord for supplying light to a remote work area, the improvement comprising in combination:

reflector means for reflecting and directing the reflected light from the light bulb of the bulb-handle assembly in a specific direction, said reflector means including a reflector shield;

guard assembly means substantially encircling said bulb and the reflector shield to prevent accidental contact with said light bulb by a user, said guard assembly means including a plurality of wires arranged in a guard orientation;

said reflector shield and guard assembly means each further including first positioning means for positioning said reflector shield a predetermined distance away from said light bulb and said guard assembly means, said first positioning means including first collar means disposed on said reflector shield and second collar means disposed on said guard assembly means, said first collar means being disposed within said second collar means, said first positioning means further including means for aligning said reflector shield within said guard assembly means, the alignment means including detent means disposed on said first collar means, said first collar detent means engaging a corresponding detent means on said second collar;

said guard assembly further including second positioning means for maintaining said predetermined distance between said reflector shield and said guard assembly means, the second positioning means further preventing substantial contact between said reflector shield and said guard assembly means.

2. The trouble light shield of claim 1, wherein said guard assembly means includes thermal and electrical insulation means.

3. The trouble light shield of claim 1, wherein said second positioning means includes a plurality of posts extending from said guard assembly means, said posts engaging said reflector shield and maintaining said predetermined distance between said reflector shield and said guard assembly means, whereby relative movement between said reflector shield and said guard assembly means and substantial contact therebetween is prevented.

4. The trouble light shield of claim 1, wherein said second positioning means includes rim means disposed on the periphery of said reflector shield, said rim means engaging said guard assembly means to maintain said reflector shield of its predetermined distance from said guard assembly means, whereby relative movement of said reflector shield with respect to said guard assembly means and substantial contact therebetween is prevented.

5. The trouble light shield of claim 1, further including heat transfer means engaging said reflector shield for disapating any heat transferred from said reflector shield to said guard assembly means.

6. The trouble light shield of claim 1, wherein said second positioning means further includes post means extending from said guard assembly means and engaging said reflector shield to maintain said predetermined distance between said reflector shield and said guard assembly means and to prevent substantial contact between said reflector shield and said guard assembly means.

7. The trouble light shield of claim 1, wherein said guard assembly means further includes a fixed guard portion and a pivotable access portion.

8. The trouble light shield of claim 7, wherein said guard assembly means includes a plurality of radially spaced, vertical wires.

9. An improved trouble light having an elongate handle member having an electrical light socket and a light bulb in said socket, a reflector for reflecting light from the light bulb, a guard assembly enclosing the reflector, said guard assembly including a fixed guard portion and a pivotable access portion and a cord for supplying power to said light bulb, the improvement comprising first and second positioning means associated with said reflector and said guard assembly, the first positioning means positioning said reflector a predetermined distance from said light bulb and the guard assembly, the second positioning means maintaining said predetermined distance and preventing substantial contact between said reflector and said guard assembly, said first positioning means including first collar means on said reflector and second collar means on said guard assembly, said first collar means being disposed within said second collar means, each of said first and second collar means engaging the handle member, said first positioning means further including means for aligning said reflector within said guard assembly, the alignment means including first detent means disposed on said first collar means and second detent means disposed on said second collar means, said first detent means engaging said second detent means.

10. The improved trouble light of claim 9, wherein said guard assembly in coated with a thermal and electrical insulating material.

11. The improved trouble light of claim 9, wherein said guard assembly includes a plurality of adjacent wires which are radially spaced apart from each other.

12. The improved trouble light of claim 9, wherein said second positioning means includes at least one post associated with said guard assembly, said post engaging said reflector and maintaining said reflector at said predetermined distance and preventing substantial contact between said reflector and said guard assembly.

13. The improved trouble light of claim 9, wherein said guard assembly includes heat transfer means to disapate any heat transferred to said guard assembly by said reflector.

14. The improved trouble light of claim 9, wherein said second positioning means includes post means associated with said guard assembly and engaging said reflector to maintain the predetermined distance between said reflector and said guard assembly, whereby relative movement of said reflector with respect to said guard assembly and substantial contact between said reflector and said guard assembly is prevented, said guard assembly further including a plurality of vertical wires radially spaced apart on said fixed guard portion, and said fixed guard portion further including heat transfer means for disapating any heat transferred to said post means, and guard assembly by said reflector.

15. The improved trouble light of claim 9, wherein said second positioning means includes rim means disposed about the periphery of said reflector, said rim means engaging said guard assembly and maintaining said reflector of said predetermined distance from said guard assembly and preventing substantial contact therebetween.

* * * * *